US007237521B2

(12) United States Patent
Yuya et al.

(10) Patent No.: US 7,237,521 B2
(45) Date of Patent: Jul. 3, 2007

(54) ENGINE STARTING METHOD AND ENGINE STARTING DEVICE

(75) Inventors: Masahiko Yuya, Yokohama (JP); Atsushi Mitsuhori, Hiratsuka (JP); Takatsugu Katayama, Isehara (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/480,543

(22) Filed: Jul. 5, 2006

(65) Prior Publication Data

US 2007/0028880 A1 Feb. 8, 2007

(30) Foreign Application Priority Data

Aug. 5, 2005 (JP) ..... 2005-227723

(51) Int. Cl.
*F02N 17/00* (2006.01)

(52) U.S. Cl. ..... 123/179.3; 123/179.1; 123/179.16

(58) Field of Classification Search ..... 123/179.1, 123/179.3, 179.16, 179.24, 491, 436; 701/104, 701/113; 180/65.2, 65.3; 74/7 R
See application file for complete search history.

(56) References Cited

U.S. PATENT DOCUMENTS 6,672,268 B2 * 1/2004 Ogawa et al. ..... 123/179.3
6,769,389 B2 * 8/2004 Tamai et al. ..... 123/179.3

FOREIGN PATENT DOCUMENTS

JP 2001-263209 9/2001

* cited by examiner

*Primary Examiner*—Stephen K. Cronin
*Assistant Examiner*—Ka Chun Leung
(74) *Attorney, Agent, or Firm*—Global IP Counselors, LLP

(57) ABSTRACT

An engine starting method includes maintaining a rotation speed of a crankshaft of an engine rotated by a motor at a first rotation speed, supplying fuel to the engine and igniting the fuel while the crankshaft is rotated by the motor at the first rotation speed, determining whether the fuel has been ignited in the engine, and maintaining the rotation speed of the crankshaft rotated at least by the motor at a second rotation speed that is greater than the first rotation speed upon determining that the fuel has been ignited.

17 Claims, 11 Drawing Sheets

ENGINE STARTING METHOD AND ENGINE STARTING DEVICE

CROSS-REFERENCE TO RELATED APPLICATIONS

This application claims priority to Japanese Patent Application No. 2005-227723 filed on Aug. 5, 2005. The entire disclosure of Japanese Patent Application No. 2005-227723 is hereby incorporated herein by reference.

BACKGROUND OF THE INVENTION

1. Field of the Invention

The present invention relates to an engine starting device for starting an internal combustion engine using an electric motor connected to the output shaft of the engine.

2. Background Information

Japanese Laid-Open Patent Publication No. 2001-263209 discloses a conventional engine starting device that stops the engine while idling to improve fuel economy. The conventional engine starting device starts an motor when a command is received to generate a predetermined starting torque in the motor when restarting the engine, and performs feedback control of the power supplied to the motor so that the actual motor rotation speed matches a target rotation speed when the motor rotation speed reaches a predetermined rotation speed near the target rotation speed.

There are engines, which are installed in idling stop vehicles, in which an intake valve closed position or timing is retarded toward the compression top dead center when the engine is restarted in order to improve fuel consumption and to reduce vibration. With such engines, since there is low charging efficiency per unit cylinder in this type of engines (i.e., the amount of air to be compressed in the cylinder is small), the compression temperature of the piston is low. Therefore, it is difficult for the engine to start combustion (e.g., it is difficult to ignite the air-fuel mixture) unless the compression process is repeated several times, particularly when the vehicle is operating in a low temperature environment.

SUMMARY OF THE INVENTION

In an aspect of the present invention, an engine starting method includes maintaining a rotation speed of a crankshaft of an engine rotated by a motor at a first rotation speed, supplying fuel to the engine and igniting the fuel while the crankshaft is rotated by the motor at the first rotation speed, determining whether the fuel has been ignited in the engine, and maintaining the rotation speed of the crankshaft rotated at least by the motor at a second rotation speed that is greater than the first rotation speed upon determining that the fuel has been ignited.

Moreover, in another aspect of the present invention, an engine includes a furl supplying device, an ignition device, a motor and a control unit. The fuel supplying device is configured and arranged to supply fuel to the engine. The ignition device is configured and arranged to ignite the fuel supplied from the fuel supplying device. The motor is configured and arranged to crank a crankshaft of the engine when starting the engine. The control unit is coupled to the fuel supplying device, the ignition device, and the motor. The control unit is configured to control the motor to maintain a rotation speed of the crankshaft rotated by the motor at a first rotation speed, to supply fuel to the engine and ignite the fuel while the crankshaft is rotated by the motor at the first rotation speed, to determine whether the fuel has been ignited in the engine, and to control the motor to maintain the rotation speed of the crankshaft rotated at least by the motor at a second rotation speed that is greater than the first rotation speed upon determining that the fuel has been ignited.

The objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
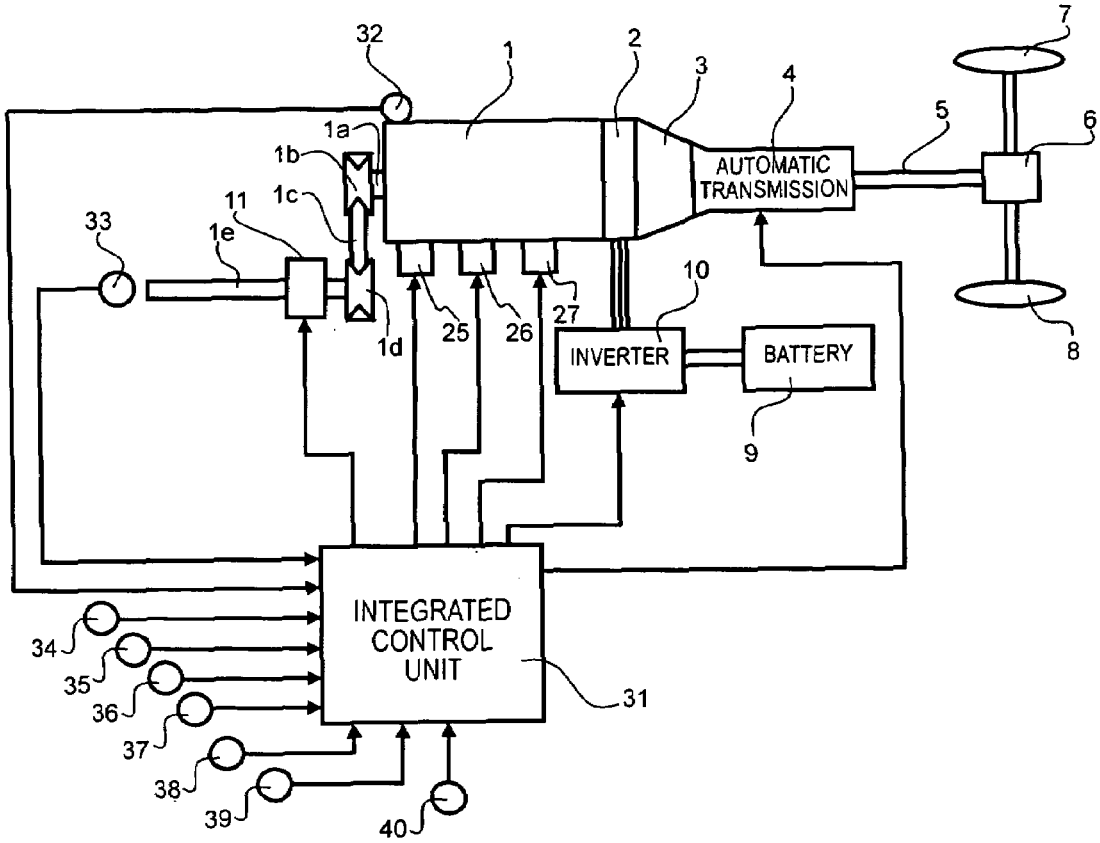
FIG. 1 is a schematic diagram of an engine starting device that is applied to an idling stop vehicle in accordance with an embodiment of the present invention.

FIG. 1 illustrates an overall system of the engine starting method and the engine starting device using the engine starting method where the engine starting device is applied to an idling stop vehicle.

In this system, a rotation shaft of an electric motor (motor generator) 2 is directly connected to an output shaft of an engine 1. Thus, an automatic transmission 4 with a torque converter 3 is directly connected through the motor 2 to the output side of the engine 1, so as to drive a pair of drive wheels 7 and 8 via an output shaft 5 of the transmission 4 and the differential gear 6.

The motor 2 is connected to a high voltage battery 9 via an inverter 10. When starting the engine 1 (starting after an idling stop, and starting after an engine key switch is turned on), the operation of the motor 2 commences via power supplied from the high voltage battery 9. At times other than engine starting, the motor 2 serves as a generator that charges the battery 9. Thus, the battery 9 can be smaller since the motor 2 is mainly used for starting the engine 1 with an idling stop device.

The engine 1 is provided with an intake valve timing control device (hereinafter referred to as "VTC device") 11 for continuously controlling the phase of the intake valve cam at a fixed operating angle disposed medially to a cam sprocket 1*d* and intake valve camshaft 1*e*. A timing chain 1*c* is reeved around the cam sprocket 1*d* and crank sprocket 1*a*, such that the power of the crankshaft 1*a* is transmitted to the intake valve camshaft 1*e*.

An integrated control unit 31 is configured to control the operation of the VTC device 11 in addition to the operation of the engine 1 (specifically, a fuel supplying device 25, an ignition device 26, and a throttle device 27), the motor 2 and the automatic transmission 4. The integrated control unit 31 is configured to receive signals from an engine key switch 34, a crankshaft position sensor 32, a camshaft position sensor 33, an accelerator pedal sensor 35 for detecting the amount of depression of the accelerator pedal, a throttle valve sensor 36 for detecting the degree of opening of the throttle valve (part of the throttle device 27), an idle switch 37 which is turned ON when the throttle valve is completely closed or the accelerator pedal is not depressed, a brake switch 38 which is turned ON when the brake pedal is depressed, a vehicle speed sensor 39 for detecting vehicle speed, and a coolant temperature sensor 40 for detecting the engine coolant temperature. The engine rotation speed (motor rotation speed) Ne is calculated based on the signals from the crankshaft position sensor 32 and the camshaft position sensor 33.

The integrated control unit 31 preferably includes a microcomputer with an engine starting control program that controls the engine starting device as discussed below. The integrated control unit 31 can also include other conventional components such as an input interface circuit, an output interface circuit, and storage devices such as a ROM (Read Only Memory) device and a RAM (Random Access Memory) device. The microcomputer of the integrated control unit 31 is programmed to control the various components of the vehicle. The memory circuit stores processing results and control programs such as ones for engine starting operation that are run by the processor circuit. The integrated control unit 31 is operatively coupled to the VTC device 11, the fuel supplying device 25, the ignition device 26, the throttle device 27, the motor 2 and the automatic transmission 4 in a conventional manner. The internal RAM of the integrated control unit 31 stores statuses of operational flags and various control data. The integrated control unit 31 is capable of selectively controlling any of the components of the control system in accordance with the control program. It will be apparent to those skilled in the art from this disclosure that the precise structure and algorithms for the integrated control unit 31 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

In the engine 1, the intake valve closed position or timing is retarded toward the compression top dead center using the VTC device 11 when restarting the engine 1 in order to improve fuel consumption and reduce vibration. Since there is low charging efficiency per unit cylinder in the engine 1 (i.e., the amount of air compressed in the cylinder is small), the compression temperature of the piston is low. Therefore, it is difficult for the engine to start combustion (i.e., it is difficult to start ignition) unless the compression process is repeated several times, particularly when the vehicle is operating in a low temperature environment.

If cranking is performed at a high target rotation speed to rapidly start the engine, duration or running time of the battery 9 is reduced. Thus, there is a possibility the engine 1 will not restart. Therefore, it is preferable to maintain a target rotation speed set at a lowest rotation speed in a range capable of starting the engine 1 until combustion begins. The reason for this is that maintaining the lowest target rotation speed in a range capable of starting the engine 1 until combustion starts reduces the total power consumption of the battery 9, and increases the duration of the battery 9.

After combustion begins (initial combustion), it becomes necessary to raise the target rotation speed since the engine rotation speed caused by the torque generated by the engine 1 increases so as to be higher than the target rotation speed set at the beginning of cranking when combustion begins via the supplied fuel and ignition while cranking. Moreover, reduction time of the engine friction torque becomes smaller when the target rotation speed is increased after the engine 1 starts combustion. In other words, the engine friction torque rapidly decreases when the actual rotation speed of the engine 1 is higher. Thus, the time needed for the engine 1 to start (i.e., the time until the engine 1 can autonomously rotate regardless of the assist from the motor generator) is reduced. Therefore, it is necessary to switch to the target rotation speed that is higher than the initial target rotation speed at the beginning of cranking after combustion starts.

In the embodiment of the present invention, a lower limit rotation speed capable of combustion is set initially at the beginning of cranking as a first target rotation speed A (first rotation speed). Cranking is executed at the first target rotation speed A (for initial combustion support), and a determination is made as to whether or not the actual cranking rotation speed has increased higher than a predetermined rotation speed (that is, whether or not combustion has occurred) by comparing the actual cranking rotation speed with a threshold value. When the actual cranking rotation speed increases higher than the predetermined rotation speed (i.e., the combustion has occurred), the rotation speed is switched to a second target rotation speed B (second rotation speed) that is higher than the first target rotation speed, and the cranking continues at this second target rotation speed B (for complete combustion support), whereupon complete combustion occurs and the engine starts.

Figure 2:
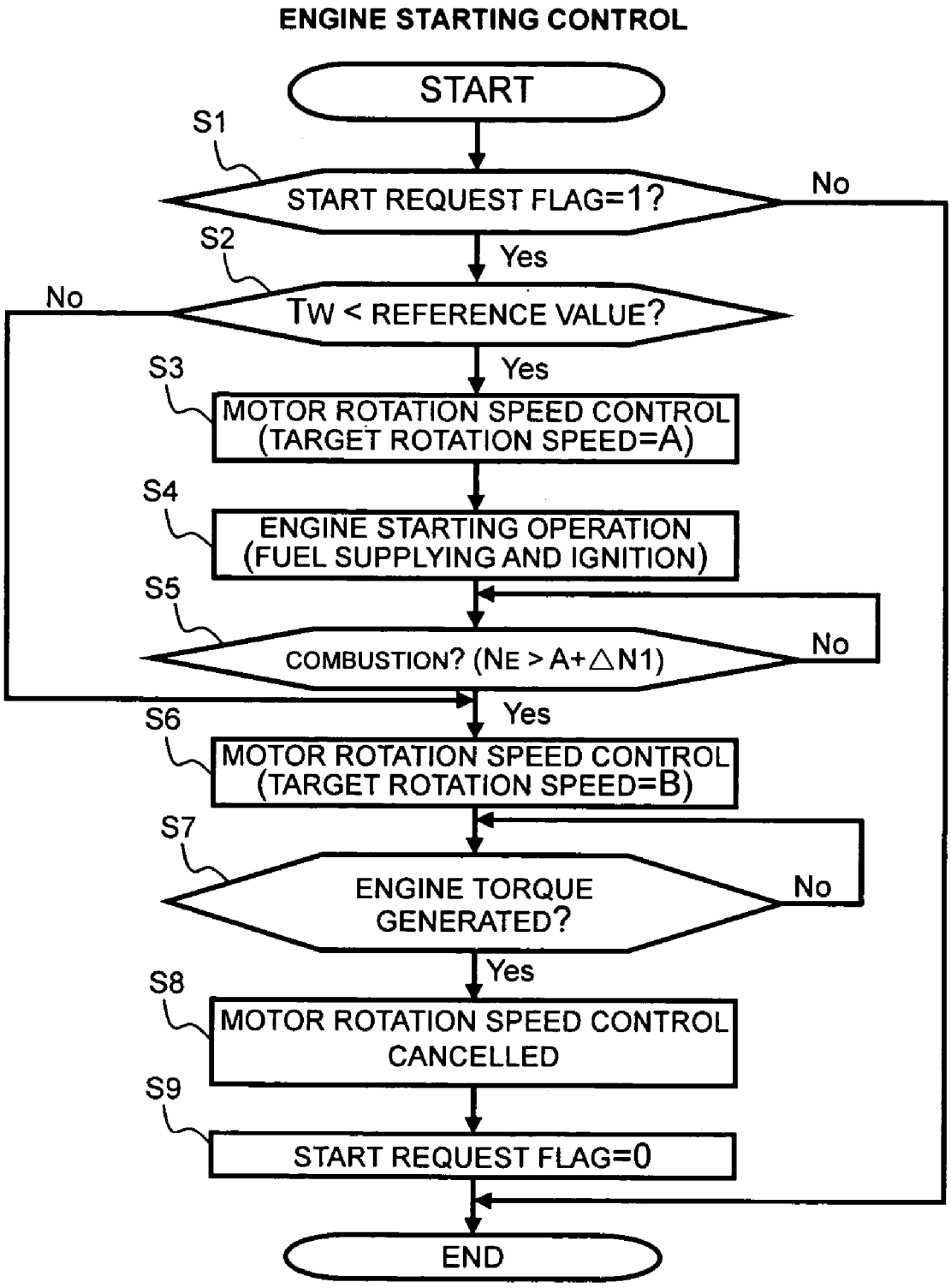
FIG. 2 is a flow chart illustrating engine starting process in accordance with the embodiment of the present invention.

The control executed by the integrated control unit 31 is described below with referring to the flow chart of FIG. 2. FIG. 2 is a flow chart for the execution of the engine start control, and shows the flow of the control over time. The control shown in FIG. 2 is not a control that is executed periodically.

In step S1 of FIG. 2, the integrated control unit 31 is configured to determine whether or not a start request flag is 1 (i.e., start request: YES). The start request flag is set by another routine when the engine 1 is started normally by the engine key switch 34 (start switch), as well as when the engine 1 is automatically started when an idling stop cancelling condition occurs after the engine 1 has been automatically stopped during an idling stop condition.

The idling stop condition occurs, for example, when the vehicle is in an idling operation condition in which the idle switch 37 is turned ON, an engine rotation speed Ne is near an idling rotation speed and a vehicle speed is zero, and when the brake switch 38 is also turned ON. The idling stop cancelling condition occurs, for example, when the idle switch 37 is turned OFF (accelerator pedal is depressed) and the brake switch 38 is also turned OFF after an idling stop.

When the start request flag is 1 (i.e., start request: YES), the routine continues to step S2, and the coolant temperature Tw (engine coolant) detected by the coolant temperature sensor 40 is compared to a reference value. The reference value is a value for determining whether or not to execute the engine start control of the present embodiment. For example, the reference value may be set in a range between −10° C. to −20° C. When the coolant temperature Tw is less than the reference value, the routine proceeds to step S3 to execute the engine start control of the embodiment of the present invention.

Figure 3:
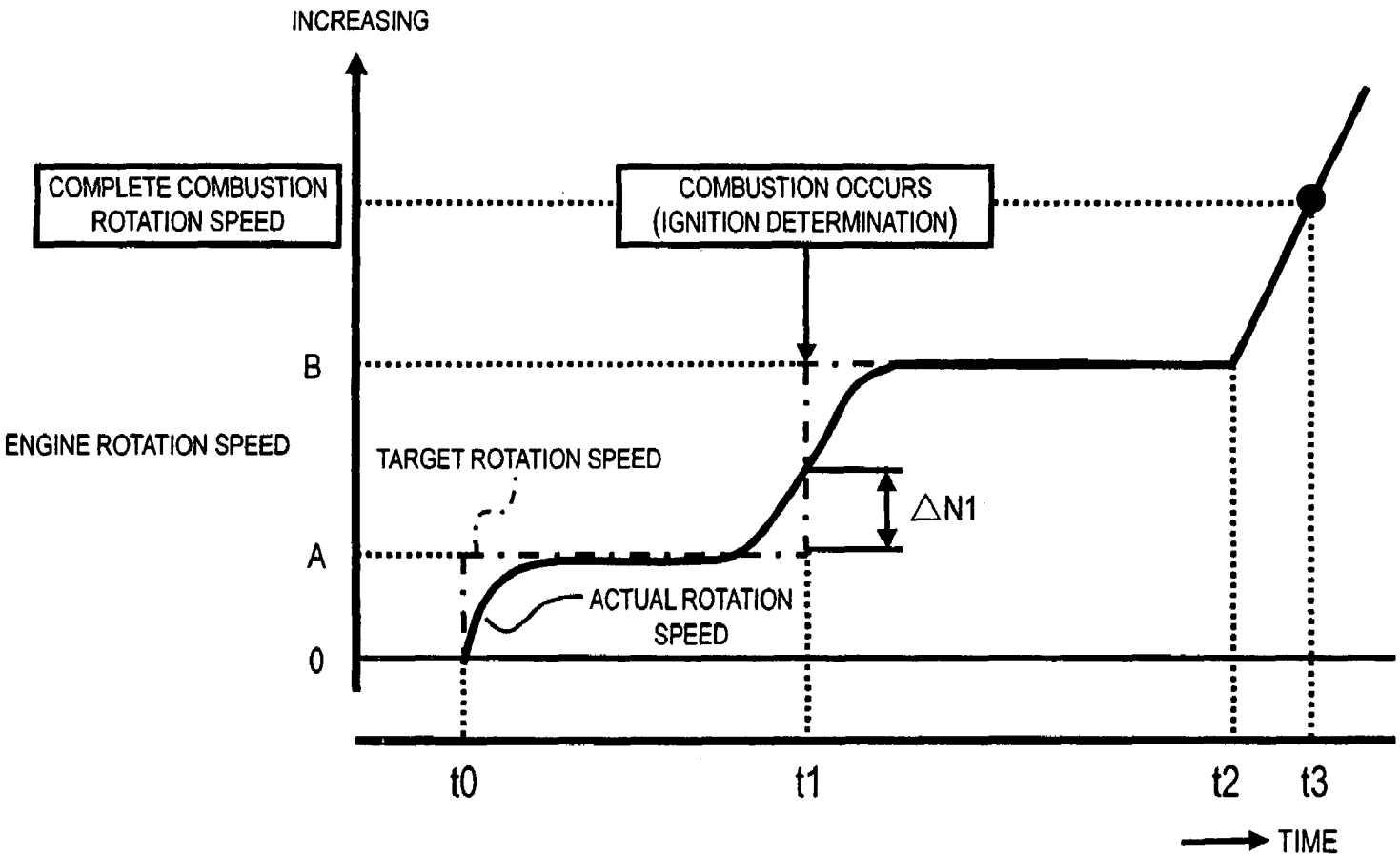
FIG. 3 is a waveform diagram of the change in an engine rotation speed after cranking starts in accordance with the embodiment of the present invention.

The operations of steps S3 and S4 are executed simultaneously. First, in step S3, rotation speed control of the motor 2 is performed via the inverter 10. The rotation speed control of the motor 2 is a feedback control for matching the actual engine rotation speed Ne with the first target rotation speed A by applying to the motor 2 a torque corresponding to the difference between the motor rotation speed (=engine rotation speed) Ne and the first target rotation speed A. As shown in FIG. 3, for example, when the target rotation speed (indicated by the dashed line) increases in step toward the first target rotation speed A at the cranking start time t0, the actual engine rotation speed (indicated by the solid line) tracks the first target rotation speed A with a first order delay.

In step S4, the engine starting operation is performed. Specifically, fuel supply to the engine 1 via the fuel supplying device 25 is started, and ignition via the ignition device 26 is started. The controls of the fuel supply and ignition are the same as the conventional art. The fuel supplying device 25 of the engine 1 is, for example, configured and arranged in which the fuel injection valve injects the fuel in the intake port. During engine starting, the fuel injection amount supplied via the fuel injection valve is set such that the target air/fuel ratio is set to the stoichiometric air/fuel ratio.

In step S5, the integrated control unit 31 is configured to determine whether or not ignition (combustion start) has occurred in the engine 1. When combustion starts, an engine torque is generated via the combustion energy and the actual engine rotation speed increases above the rotation speed (A) which obtained up to that point, as shown in FIG. 3. A value, which is obtained by adding a predetermined amount ΔN1 to the first target rotation speed A determined in step S3, is set as a threshold value. The actual engine rotation speed is compared to the threshold value (=A+ΔN1), and it is determined that combustion has started (ignition has occurred) when the actual engine rotation speed exceeds the threshold value.

The integrated control unit 31 is configured to wait in step S5 until ignition occurs. When ignition occurs, the routine proceeds to step S6, and the rotation speed control of the motor 2 by the inverter 10 is performed. The rotation speed control of the motor 2 is a feedback control for matching the actual engine rotation speed Ne to the second target rotation speed B by supplying to the motor 2 a torque command corresponding to the difference between the motor rotation speed (=engine rotation speed) Ne and the second target rotation speed B that is higher than the first target rotation speed A. As shown in FIG. 3, for example, when the target rotation speed is increased in step from the first target rotation speed A to the second target rotation speed B at ignition determination timing t1, the actual engine rotation speed (indicated by the solid line) tracks the second target rotation speed B with a first order delay.

A method of setting the first and second target rotation speeds A and B, and the ignition determination method are described in detail below with reference to FIGS. 4 to 13.

Figure 4:
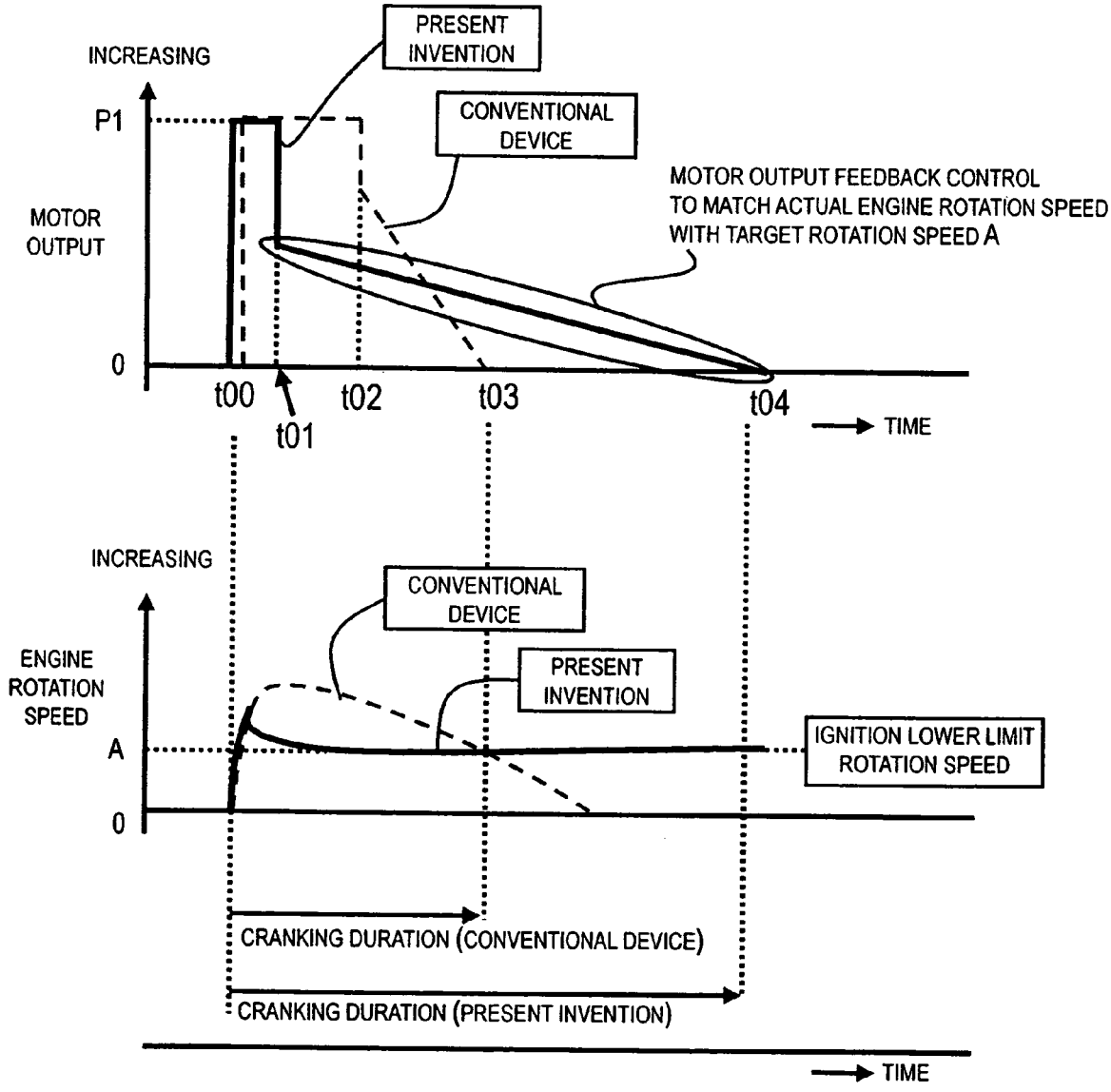
FIG. 4 is a waveform diagram showing a motor output and the engine rotation speed over time in accordance with the embodiment of the present invention.

FIG. 4 shows the change in the motor output and engine rotation speed before ignition occurs (before combustion start time). The dashed line represents a conventional device. In the conventional device, the time over which the cranking rotation speed is raised above an ignition lower limit rotation speed, at which ignition of the fuel is achievable and rotation rise according to ignited combustion can be caused when the fuel has been supplied and ignited, is long, and battery power is needlessly consumed. In other words, in the conventional device as shown in an upper portion of FIG. 4, after a large motor power P1 has been applied during a prescribed period between the cranking start timing t00 to time t02, the motor output gradually decreases, until the motor output becomes zero at time t03. During this operation, as shown in the lower portion of FIG. 4, the engine rotation speed greatly exceeds the ignition lower limit rotation speed in all segments since the motor is working from time t00 until time t03. Thus, the conventional device cannot start the engine if the engine is not started within the segments up to time t03 (cranking duration of the conventional device).

On the other hand, the solid line in FIG. 4 represents the embodiment of the present invention. As shown in the upper portion of FIG. 4, a large motor power P1 is applied only for a short time (time t00 to time t01) and the ignition lower limit rotation speed is set as the first target rotation speed A. Since the feedback control is started at time t1 so as to match the actual engine rotation speed to the first target rotation speed A, the engine rotation speed is held near the first target rotation speed A, and thus, the period of cranking duration in the embodiment of the present invention extends until time t04, as shown in the lower portion of FIG. 4. Thus, in the embodiment of the present invention, the time during which the battery 9 is usable is extended from time t03 to time t04 comparing to the conventional device, and the engine 1 can be started during the segments up to t04 (cranking duration of the embodiment of the present invention).

Figure 5:
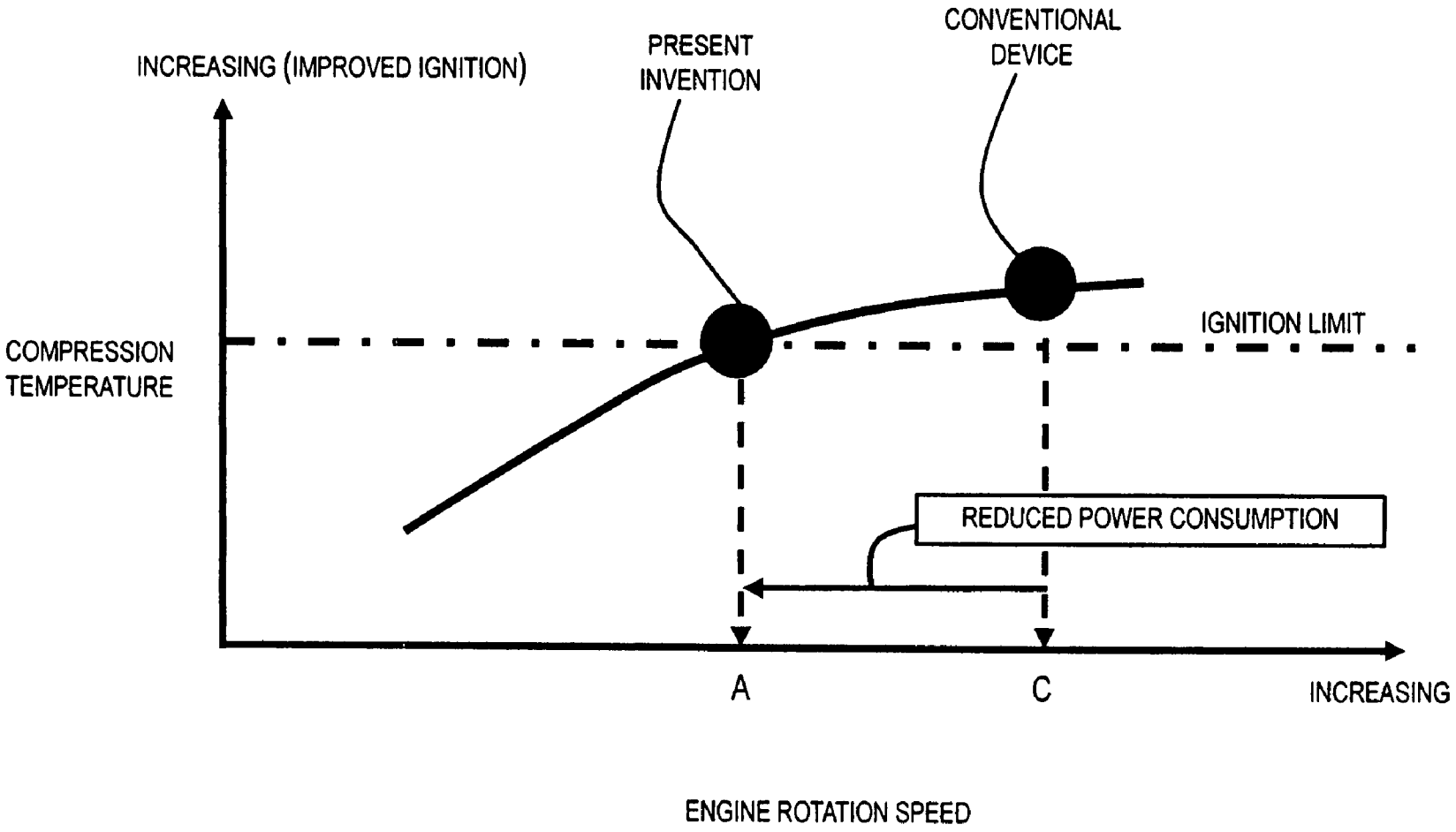
FIG. 5 is a diagram illustrating compression temperature characteristics with respect to a cranking rotation speed in accordance with the embodiment of the present invention.

FIG. 5 shows the difference between the embodiment of the present invention and the conventional device from a different aspect than FIG. 4. The characteristics curve shown in FIG. 5 indicates that the compression temperature of the gas by the piston within the combustion chamber increases and ignition (ignitionability) becomes excellent as the engine rotation speed (cranking rotation speed) becomes higher. Thus, the embodiment of the present invention starts cranking at the ignition lower limit engine rotation speed (that is, the target rotation speed A). In contrast, the conventional device performs cranking at an engine rotation speed C that is greater than the ignition lower limit engine rotation speed. Therefore, the embodiment of the present invention reduces power consumption of the battery 9 by difference in engine rotation speed (=C−A) as shown in FIG. 5.

Figure 6:
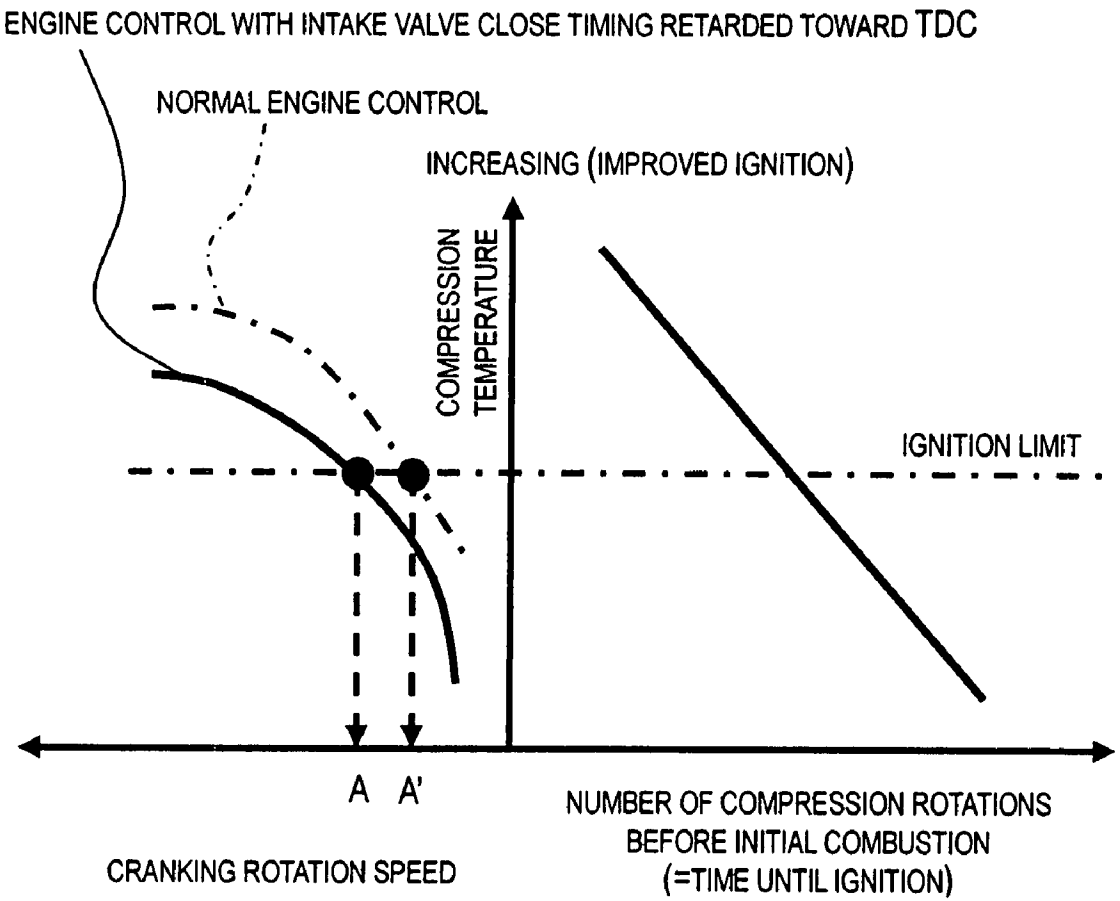
FIG. 6 is a diagram illustrating a relationship among the cranking rotation speed, the compression temperature, and time elapsed before ignition occurs in accordance with the embodiment of the present invention.

FIG. 6 shows the effect of the difference in the intake valve close timing on the engine rotation speed during cranking. Since the engine 1 is installed in the idling stop vehicle in FIG. 1, the VTC device 11 is configured and arranged to operate when restarting the engine 1, and the intake valve close timing is retarded (solid line) toward the compression top dead center comparing to a normal engine control (single dash chain line). In the normal engine control, the intake valve close timing is in the vicinity of bottom dead center. With regard to an engine applied to an idling stop vehicle, by setting the intake valve close timing, which is retarded toward the compression top dead center when restarting the engine 1, so as to delay the intake valve close timing toward the compression top dead center, decreases the charging efficiency per unit cylinder (i.e., the amount of air compressed within the cylinder is small). Therefore, the fuel consumption is reduced, vibration is suppressed, and quiet starting is accomplished when restarting the engine 1.

When the intake valve close timing is retarded toward compression top dead center, in order to obtain the same compression temperature as a normal engine during cranking, the engine rotation speed must be higher than that of a normal engine control. The engine 1 with the intake valve close timing retarded toward the compression top dead center has a lower compression temperature than when the engine 1 is controlled normally. When the intake valve close timing is retarded toward compression top dead center, the compression heat escapes via the piston, and the air in the compression chamber returns to the intake port, thus the compression temperature is lower than when the engine is controlled normally. Accordingly, in order to eliminate these two causes, the engine rotation speed during cranking must be increased to obtain the same compression temperature as a normal engine control.

Although the embodiment of the present invention focuses on an engine in which the intake valve close timing is retarded toward the compression top dead center, the present invention is not limited only to such an engine and also may be applied to an engine without such intake valve close timing control. For example, when applied to a normal engine control, A' in FIG. 6 may be set as the first target rotation speed A since FIG. 6 shows a difference in the cranking rotation speeds (left side in FIG. 6) between a normal engine control and an engine control in which the intake valve close timing is retarded toward the compression top dead center.

Figure 7:
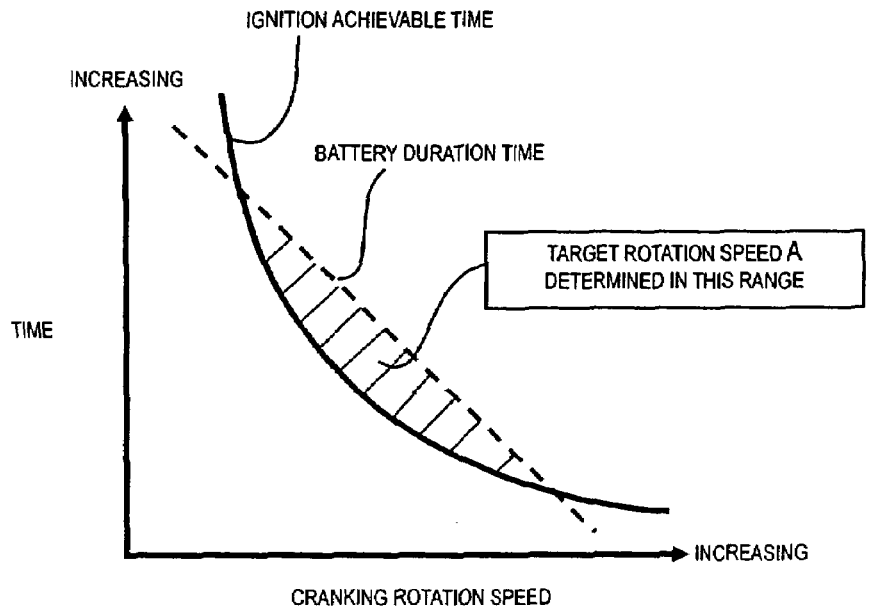
FIG. 7 is a diagram illustrating how a first target rotation speed A is set in accordance with the embodiment of the present invention.
Figure 8:
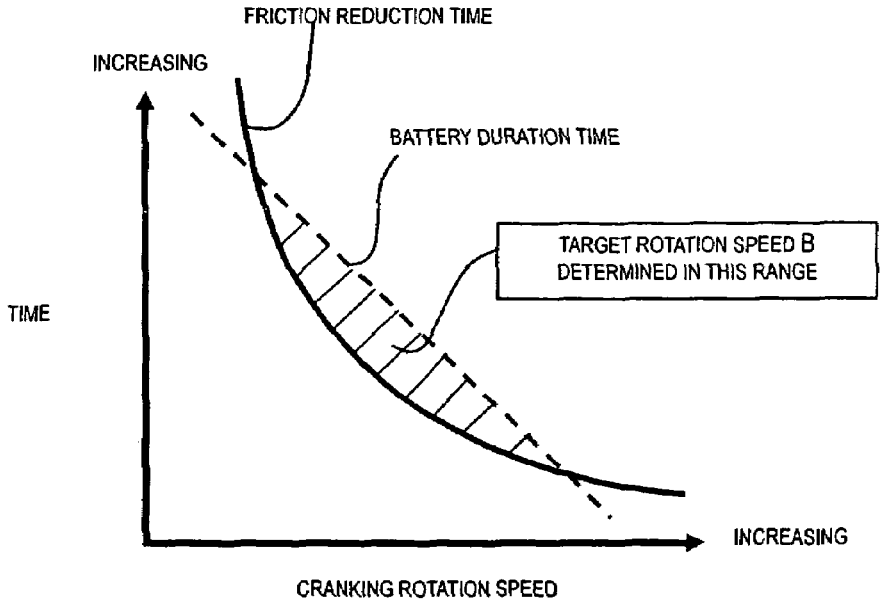
FIG. 8 is a diagram illustrating how a second target rotation speed B is set in accordance with the embodiment of the present invention.

In order to realize the first and second target rotation speeds A and B at two stages shown in FIG. 3 (single dash chain line), the first target rotation speed A is set within a range encompassing (balancing) both the ignition achievable time (time during which there is a high possibility of combustion with continuous rotation) and battery duration time. Moreover, and the second target rotation speed B is set within a range encompassing (balancing) both a friction torque reduction time (time during which there is sufficient reduction of the friction torque with continuous rotation) and the battery duration time. In other words, as shown in FIG. 7, the battery duration time decreases linearly and the ignition achievable time decreases with inverse proportionality as the cranking rotation speed increases. Thus, the target rotation speed A is set within the hatched region as shown in FIG. 7. Furthermore, the battery duration time decreases linearly and the friction reduction time decreases with inverse proportionality as the cranking rotation speed increases as shown in FIG. 8. Thus, the target rotation speed B is set within the hatched region shown in FIG. 8. Therefore, the specifications of the battery 9, the motor 2, and the engine 1 are determined so as to produce the hatched regions (region of the first and second target rotation speeds A and B) shown in FIGS. 7 and 8.

Figure 9:
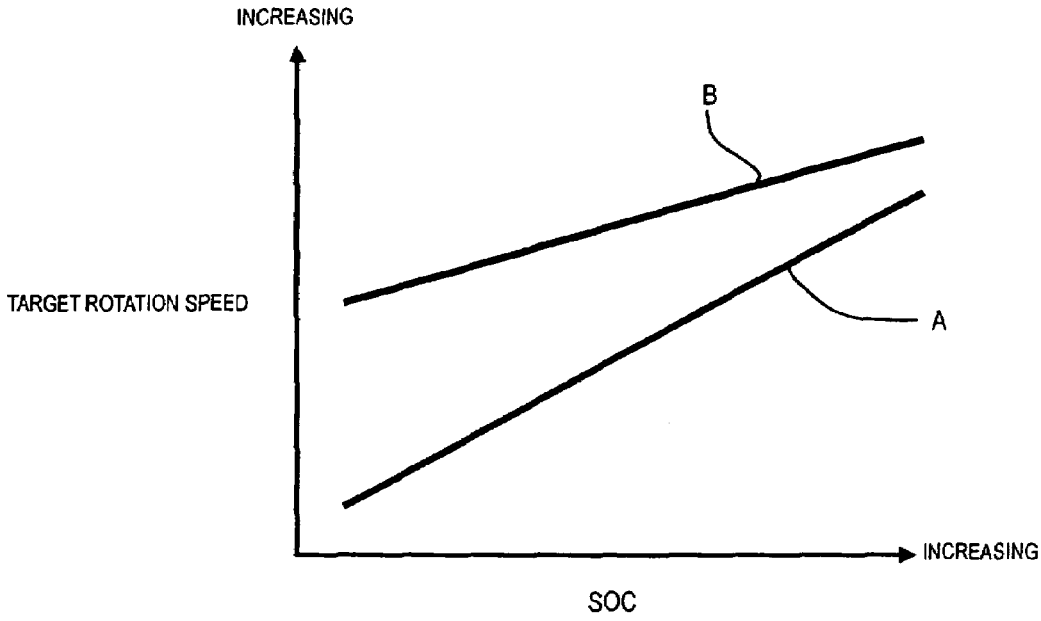
FIG. 9 is a diagram of characteristics of the target rotations speeds with respect to state-of-charge of a batter in accordance with the embodiment of the present invention.

The first and second target rotation speeds A and B are set according to the SOC (state-of-charge value) representing the battery capacity (specifically, the remaining battery capacity) assuming the coolant temperature conditions are identical, as shown in FIG. 9. When the SOC is high if the coolant temperature conditions are identical, the first and second target rotation speeds A and B increase in order to start the engine 1 in a short time. When the SOC is low if the coolant temperature conditions are identical, the first and second target rotation speeds A and B decrease so as to ensure that the engine 1 starts.

Figure 10:
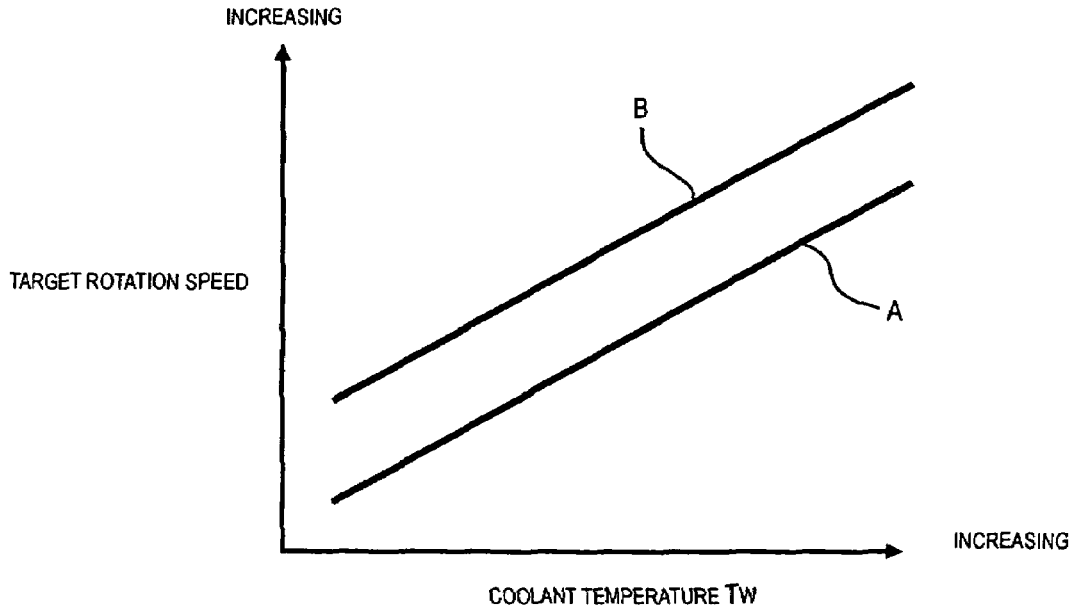
FIG. 10 is a diagram of characteristics of the target rotation speeds with respect to coolant temperature in accordance with the embodiment of the present invention.

As shown in FIG. 10, the first and second target rotation speeds A and B are set according to the coolant temperature Tw if the SOC conditions are identical. As shown in FIG. 10, when the coolant temperature Tw is low and the SOC conditions are identical, the first and second target rotation speeds A and B are low because the friction torque is high when the coolant temperature Tw is low.

Figure 11:
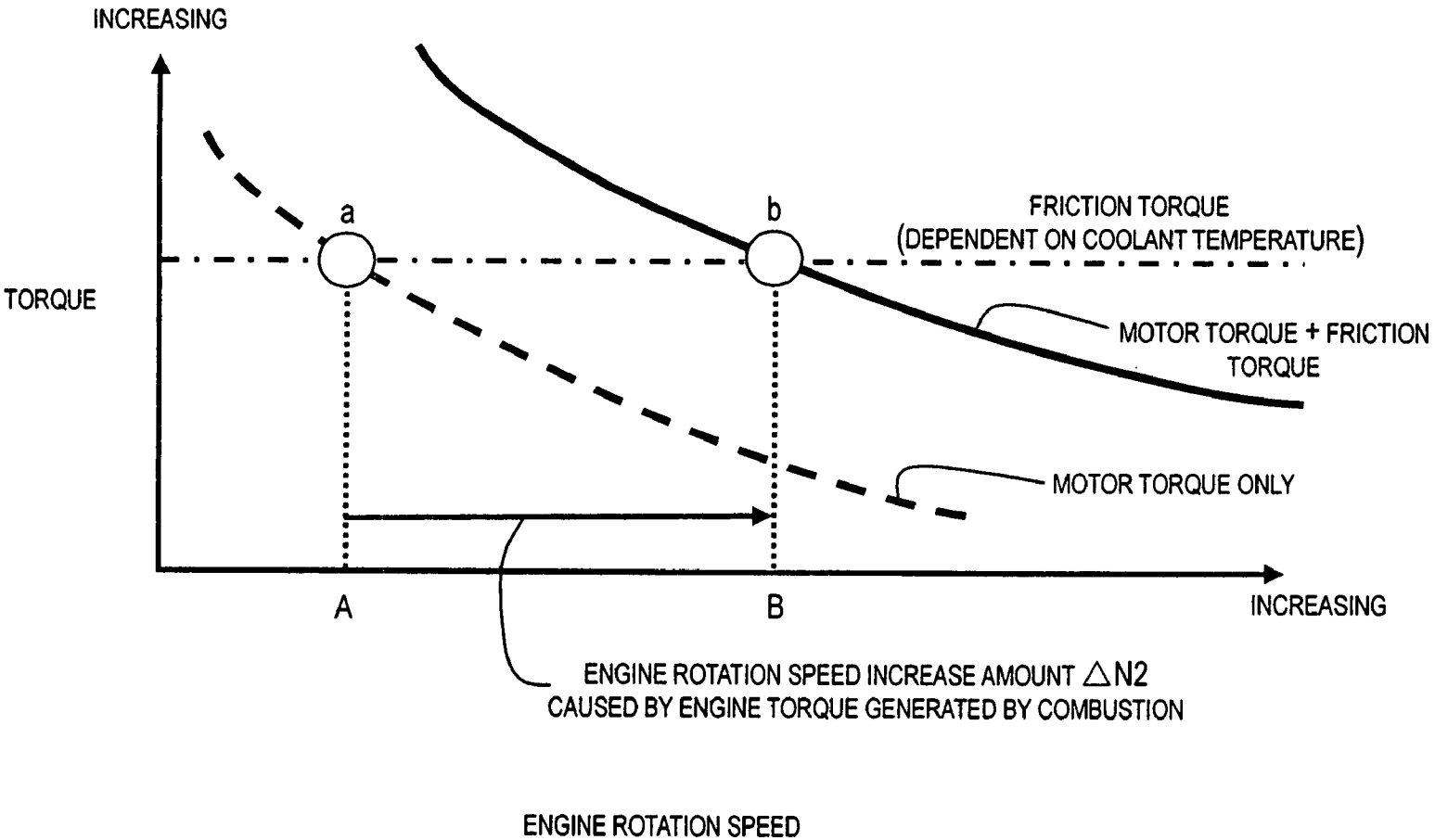
FIG. 11 is a diagram illustrating how an occurrence of combustion is determined in accordance with the embodiment of the present invention.

The combustion determining process of step S5 of FIG. 2 is accomplished by determining whether or not increase in the rotation speed due to start of combustion has occurred with respect to the actual engine rotation speed during cranking. In FIG. 11, the dashed line represents the characteristics of the motor torque relative to engine rotation speed. When the cranking rotation speed is designated at the target rotation speed A at operating point a in FIG. 11, and an engine torque is generated to start combustion, there is a horizontal movement from the operating point a to b (the target rotation speed B). That is, after combustion starts, the engine rotation speed increases from A by a rotation speed increase amount ΔN2 although the overall torque does not changed before and after combustion starts.

The values A and B in FIG. 11 are respectively first and second target rotation speeds. Since the friction torque when cranking starts is dependent on the coolant temperature (or oil temperature), the operating points a and b respectively move upward along the dashed line and solid line characteristics curves, respectively, when the coolant temperature Tw decreases and the friction torque increases. Conversely, the operating points a and b respectively move downward along the dashed line and solid line characteristics curves, respectively, when the coolant temperature Tw increases and the friction torque decreases. Thus, the target rotation speeds A and B at the operating points a and b are dependent on the coolant temperature Tw and must be set with that in mind. Therefore, the first and second target rotation speeds A and B are set dependently on the coolant temperature Tw. This is the reason why the first and second target rotation speeds A and B are set based on the coolant temperature Tw as shown in FIG. 10.

Accordingly, by setting as the threshold value SL the value obtained by adding the rotation speed increase amount ΔN2 that accompanies the start of combustion to the first target rotation speed A obtained in step 3, the actual engine rotation speed Ne can be compared to the threshold value SL, such that the start of combustion can be determined when the actual engine rotation speed Ne exceeds the threshold value SL, and lack of combustion can be determined when the actual engine speed Ne does not exceeds the threshold value SL. Alternatively, since A+ΔN2=B, the actual engine speed Ne can be compared to the second target rotation value B, such that the start of combustion can be determined when the actual engine rotation speed Ne exceeds the second target rotation speed B, and the lack of combustion can be determined when the actual engine rotation speed Ne does not exceed the second target rotation speed B. Although the difference between the first target rotation speed A and the second target rotation speed B is a rotation speed increase amount ΔN2 in FIG. 11, a value less than the difference between the first target rotation speed A and the second target rotation speed B may be used as the rotation speed increase amount ΔN1 shown in FIG. 3. Either of the rotation speed increase amounts ΔN1 and ΔN2 may be selected for this determination.

The combustion determination in step S5 is performed to determine whether or not initial combustion has occurred during cranking, and is not performed to determine whether or not complete combustion has occurred. The determination as to whether or not complete combustion has occurred is performed in step S7, which will be described later.

Figure 12:
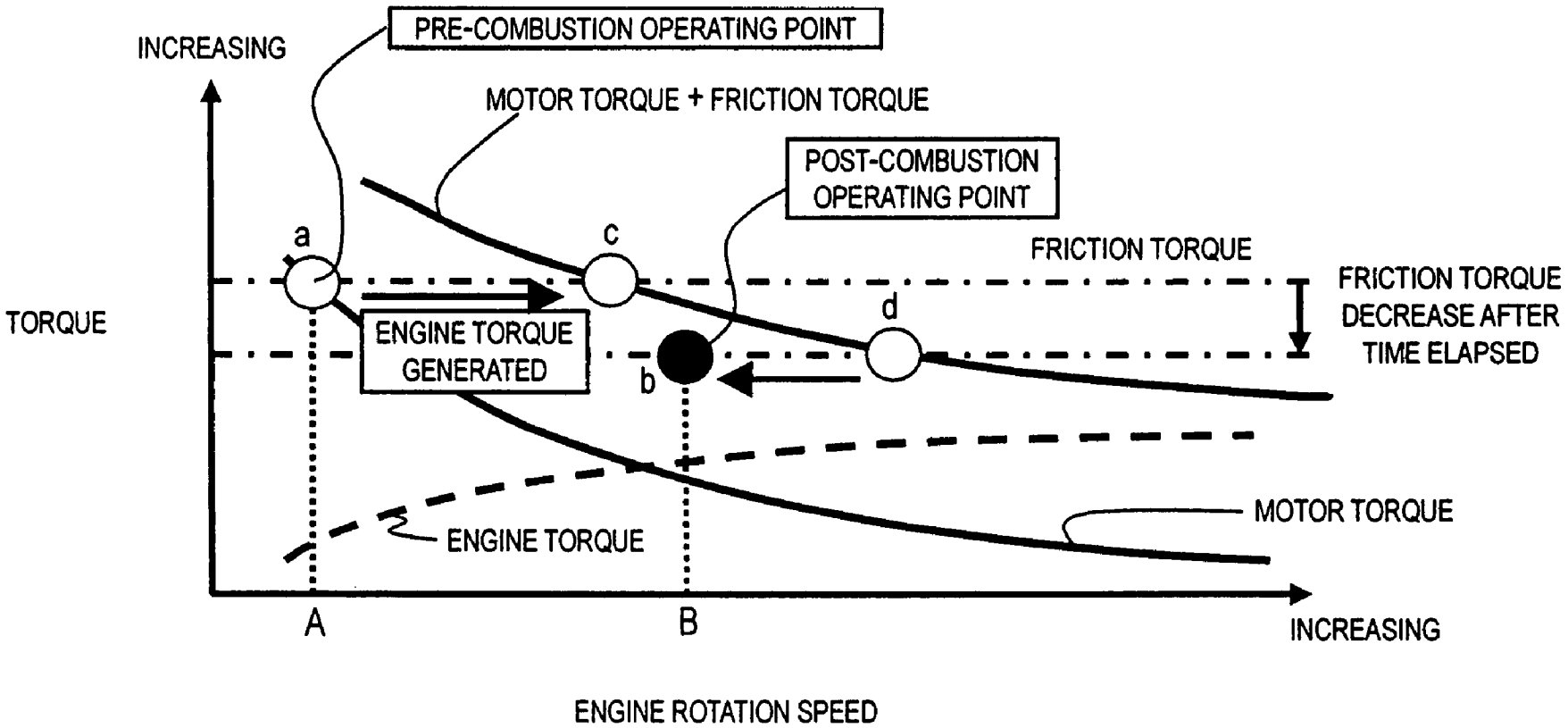
FIG. 12 is a diagram illustrating output torques with respect to engine rotation speed after the ignition occurs in accordance with the embodiment of the preset invention.

FIG. 12 shows balance of torques after the ignition occurs. In FIG. 12, the right pointing arrow indicates that the operating point of the engine 1 moves from the pre-combustion operating point a toward the increase side due to the engine torque accompanying ignition. Although the operating point would be expected to move from c to d due to the decrease in friction torque accompanying the elapsed time after combustion, this actually does not occur, and the operating point moves toward the decreasing engine rotation side as the friction torque decrease during the elapsed time after combustion, as indicated by the leftward pointing arrow. In the present embodiment, the operating points move in a sequence of a→c→b shown in FIG. 12, and settles in the operating point b after combustion.

Figure 13:
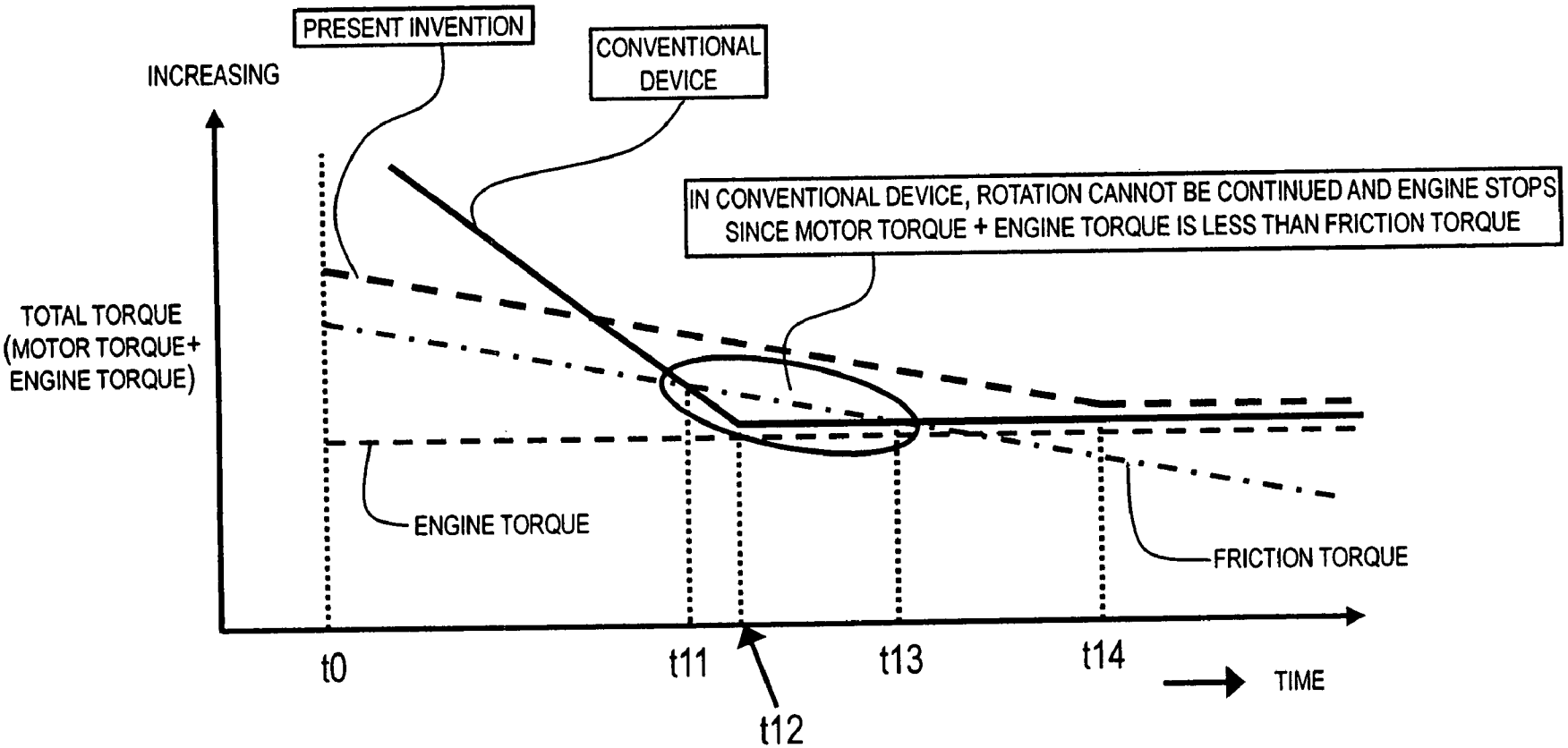
FIG. 13 is a diagram illustrating balance of torques with respect to time after the ignition occurs in accordance with the embodiment of the present invention.

FIG. 13 plots the sum of the motor torque and the engine torque on the vertical axis. The solid line represents the conventional device, and the thick dashed line represents the embodiment of the present invention. In the conventional device (also shown in FIG. 4), the motor torque rapidly decreases after increasing initially when cranking starts, and becomes "0" at time t12. Thereafter, since only the engine torque is operative, the torque characteristic of the conventional device can be represented by the bent line as shown in FIG. 13. In this case, the friction torque has characteristics shown with a dash-dot chain line shown in FIG. 13 since the engine friction torque gradually decreases from time t0 when cranking starts. Since the solid bent line of the conventional device and the friction torque dash-dot chain line overlap, the total of the engine torque and the motor torque is less than the friction torque in the segment from time t11 to time t13, which results in engine rotation, which had continued up to this time, stopping.

In the embodiment of the present invention, the total of the engine torque and the motor torque decreases along a course of predetermined values greater than the friction torque, and the motor torque becomes zero at time t14. Thereafter since only the engine torque is operative as in the conventional device, the bent line from this point also represents the embodiment of the present invention, as shown in FIG. 13.

The thick dashed line representing the embodiment of the present invention does not intersect the dash-dot chain line representing the friction torque as shown in FIG. 13. Thus, in the embodiment of the present invention, since a motor torque is generated that is higher than the friction torque throughout the segments from time t0 when cranking starts until time t14 when the motor torque becomes zero (i.e., all segments in which the motor torque is operative) the engine 1 can be started insofar as ignition occurs (combustion starts) in at any point in the segments during which the motor torque is operative. Furthermore, since there is no engine torque generated before ignition occurs, the thick dashed line in FIG. 13 is a hypothetical line representing when combustion can occur. Therefore, the engine torque plus the motor torque is actually greater than the friction torque when ignition occurs, such that combustion can begin.

This concludes the detailed description of FIGS. 4 to 13.

Returning now to the flowchart of FIG. 2, when the coolant temperature Tw is greater than the reference value in step S2, steps S3, S4, and S5 are skipped, and the operation of step S6 is executed. More specifically, since the battery 9 is in good condition when the coolant temperature Tw (engine temperature) is higher than the reference value when cranking starts, the motor rotation speed during cranking is controlled by setting the target value of the cranking rotation speed at the beginning of cranking to the second target rotation speed B that is higher than the first target rotation speed A. This concludes the description of step S6 of FIG. 2.

Next, in step S7, the integrated control unit 31 is configured to determine whether or not the engine 1 has generated torque. This determination is accomplished based on the regeneration of electrical power by the regeneration of torque through the motor 2 as a complete combustion determination method. That is, the occurrence of complete combustion is determined based on the positive-to-negative inversion of the torque of the motor 2. Simply put, the actual engine rotation speed is compared to a complete combustion rotation speed (refer to FIG. 2), and complete combustion is determined when the actual engine rotation speed is greater than the complete combustion rotation speed.

When it has been determined that the engine 1 has generated torque in step S7, the routine proceeds to step S8, and the rotation speed control of the motor 2 is cancelled. Thus, rotation fluctuation can be prevented when there is variation in the engine independence by canceling the rotation speed control of the motor 2 after it has been determined that the engine 1 has generated torque. Furthermore, the timing for canceling the rotation speed control of the motor 2 need not be immediately after the complete combustion determination for the engine 1, and may be set after time t3 in FIG. 2.

Finally, in step S9, the integrated control unit 31 is configured to reset the value of the start request flag to 0 and ends the control flow shown in FIG. 2.

The embodiment of the present invention provides an engine starting method and engine starting device for starting an engine by cranking the crankshaft 1*a* of the engine 1 by the motor 2. Since fuel is supplied and ignition executed while cranking (step S4 of FIG. 2), whether or not combustion has occurred by the fuel supplying and ignition us determined (step S5 of FIG. 2), and the motor rotation speed is controlled while cranking based on the combustion determination result (steps S3, S5, and S6 of FIG. 2), the cranking rotation speed needed to effect combustion can be set as low as possible, thus keeping the battery discharge to a minimum. The cranking duration can be increased and the possibility of starting failure can be reduced, particularly in the engine 1 in which the intake valve close timing has been retarded toward the vicinity of compression top dead center when restarting the engine 1.

Moreover, according to the embodiment of the present invention, the target values for cranking rotation speed can be optimally set for both before and after ignition occurs since a target value for cranking rotation speed before ignition occurs is set at the first target rotation speed A (first rotation speed) that is a lower limit rotation speed at which ignition is possible, and the target value is switched to a target value for cranking rotation speed after combustion has occurred, which is the second target rotation speed B (second rotation speed) that is higher then the first target rotation speed A, based on the combustion determination result.

According to the embodiment of the present invention, the torque generated in the engine 1 in conjunction with the start of combustion can be easily determined by using a value obtained by adding the rotation speed increase amount ΔN1 accompanying combustion to the first target rotation speed A (first rotation speed) as a threshold value, so as to determine whether or not combustion has occurred by comparing this threshold value (A+ΔN1) and the actual cranking rotation speed (step S5 of FIG. 2).

According to the embodiment of the present invention, motor rotation speed control during cranking is executed based on the combustion determination result when the coolant temperature Tw (engine coolant temperature) when cranking starts is less than a reference value (steps S2 and S3 to S6 of FIG. 2). Since the battery 9 is in good condition when the coolant temperature Tw is higher than the reference value when cranking starts, the motor rotation speed is controlled during cranking by switching the target value of the cranking rotation speed to the second target rotation speed B that is higher than the first target rotation speed A used when initially starting cranking (steps S2 and S6 of FIG. 2). Thus, when the coolant temperature Tw is higher than the reference value when cranking starts, starting occurs earlier than when the coolant temperature Tw is less than the reference value when cranking starts, and both starting performance and takeoff are improved regardless of the coolant temperature Tw.

According to the embodiment of the present invention, since the target values (first and second target rotation speeds A, B) during cranking change depending on the battery SOC when cranking starts, the target values are high when the SOC is large and the range within which starting is possible is lower when SOC is small (FIG. 9), starting time can be reduced when battery capacity (battery SOC) is large, and starting time can be reduced within a range that allows starting and does no lapse into a poor starting range when battery capacity is small.

Although the embodiment of the present invention has been described in terms of supplying fuel and executing spark ignition during cranking, determining whether or not combustion has occurred by the fuel supplying and spark ignition, and controlling the motor rotation speed when cranking based on the combustion determination result, it is to be noted that the motor supplied power during cranking may be controlled based on the combustion determination result.

Although the embodiment of the present invention has been described in terms of controlling the motor rotation speed when cranking based on the combustion determination result when the engine coolant temperature Tw is lower than the reference value when cranking starts, the motor supplied power during cranking can be controlled based on the combustion determination result when the engine coolant temperature Tw is lower than the reference value when cranking starts. Furthermore, the motor supplied power or the motor rotation speed during cranking may be controlled based on the combustion determination result when the battery SOC is less than a reference value when cranking starts.

Although the embodiment of the present invention has been described in terms of the invention being applied to an idling stop vehicle, the present invention is not limited to this application inasmuch as a starter may be included in the motor. Therefore, the present invention may also be applied to starting the vehicle by cranking a crankshaft of an engine by the starter.

The fuel supplying and ignition execution process sequence of the present invention corresponds to step S4 of FIG. 2, the combustion determination process corresponds to step S5 of FIG. 2, and the motor rotation speed and motor supplied power control process corresponds to steps S3, S5, and S6 of FIG. 2.

The function of the fuel supplying and ignition means corresponds to step S4 of FIG. 2, the function of the ignition determining means corresponds to step S5 of FIG. 2, and the functions of the first and second rotation speed maintaining means correspond to steps S3, S5, and S6 of FIG. 2.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An engine starting method comprising:

maintaining a rotation speed of a crankshaft of an engine rotated by a motor at a first rotation speed;

supplying fuel to the engine and igniting the fuel while the crankshaft is rotated by the motor at the first rotation speed;

determining whether the fuel has been ignited in the engine; and subsequently after the rotation speed of the crankshaft has been increased from the first rotation speed, maintaining the rotation speed of the crankshaft rotated at least by the motor at a second rotation speed that is greater than the first rotation speed upon determining that the fuel has been ignited.

2. The engine starting method according to claim 1, wherein the maintaining of the rotation speed of the crankshaft at the first rotation speed includes setting the first rotation speed to an ignition lower limit rotation speed at which ignition of the fuel is achievable when the fuel has been supplied and ignited.

3. The engine starting method according to claim 2, wherein the maintaining of the rotation speed of the crankshaft at the first rotation speed and the second rotation speed includes performing feedback control of power supplied to the motor so that an actual rotation speed of the crankshaft matches a respective one of the first rotation speed and the second rotation speed.

4. The engine starting method according to claim 1, wherein the determining of whether the fuel has been ignited in the engine includes comparing an actual rotation speed of the crankshaft with a threshold value obtained by adding a rotation speed increase amount due to the fuel being ignited to the first rotation speed.

5. The engine starting method according to claim 1, further comprising performing the maintaining of the rotation speed of the crankshaft at the first rotation speed when an engine coolant temperature is lower than a reference value when cranking of the engine starts.

6. The engine starting method according to claim 1, further comprising performing the maintaining of the rotation speed of the crankshaft at the first rotation speed when a state-of-charge value of a battery is less than a reference value when cranking of the engine starts.

7. The engine starting method according to claim 1, further comprising setting the first rotation speed and the second rotation speed such that the smaller a state-of-charge value of a battery when cranking of the engine starts is, the lower the first rotation speed and the second rotation speed are.

8. The engine starting method according to claim 1, further comprising retarding an intake valve close timing of the engine toward compression top dead center at least when the engine is restarted.

9. An engine starting device comprising:

a fuel supplying device configured and arranged to supply fuel to an engine;

an ignition device configured and arranged to ignite the fuel supplied from the fuel supplying device;

a motor configured and arranged to crank a crankshaft of the engine when starting the engine; and a control unit operatively coupled to the fuel supplying device, the ignition device, and the motor, and configured to control the motor to maintain a rotation speed of the crankshaft rotated by the motor at a first rotation speed, supply fuel to the engine and ignite the fuel while the crankshaft is rotated by the motor at the first rotation speed, determine whether the fuel has been ignited in the engine, and control the motor, subsequently after the rotation speed of the crankshaft has been increased from the first rotation speed, to maintain the rotation speed of the crankshaft rotated at least by the motor at a second rotation speed that is greater than the first rotation speed upon determining that the fuel has been ignited.

10. The engine starting device according to claim 9, wherein the control unit is further configured to set the first rotation speed to an ignition lower limit rotation speed at which ignition of the fuel is achievable when the fuel has been supplied and ignited.

11. The engine starting device according to claim 10, wherein the control unit is further configured to perform feedback control of power supplied to the motor to maintain the rotation speed of the crankshaft at the first rotation speed and the second rotation speed so that an actual rotation speed of the crankshaft matches a respective one of the first rotation speed and the second rotation speed.

12. The engine starting device according to claim 9, wherein the control unit is further configured to determine whether the fuel has been ignited in the engine by comparing an actual rotation speed of the crankshaft with a threshold value obtained by adding a rotation speed increase amount due to the fuel being ignited to the first rotation speed.

13. The engine starting device according to claim 9, wherein the control unit is configured to control the motor to maintain the rotation speed of the crankshaft at the first rotation speed when an engine coolant temperature is lower than a reference value when cranking of the engine starts.

14. The engine starting device according to claim 9, wherein the control unit is configured to control the motor to maintain the rotation speed of the crankshaft at the first rotation speed when a state-of-charge value of a battery is less than a reference value when cranking of the engine starts.

15. The engine starting device according to claim 9, wherein the control unit is configured to set the first rotation speed and the second rotation speed such that the smaller a state-of-charge value of a battery when cranking of the engine starts is, the lower the first rotation speed and the second rotation speed are.

16. The engine starting device according to claim 9, further comprising an intake valve timing control device operatively coupled to the control unit, and configured and arranged to vary a close timing of an intake valve, the control unit being further configured to control the intake valve timing control device to retarded the close timing of the intake valve toward compression top dead center at least when the engine is restarted.

17. An engine starting device comprising:

a starting means for applying a rotational force to a crankshaft of an engine;

a first rotation speed maintaining means for maintaining a rotation speed of the crankshaft rotated by the starting means at a first rotation speed;

a fuel supplying and igniting means for supplying fuel to the engine and igniting the fuel while the crankshaft is rotated by the starting means at the first rotation speed;

an ignition determining means for determining whether the fuel has been ignited in the engine; and a second rotation speed maintaining means for maintaining the rotation speed of the crankshaft rotated at least by the starting means, after the crankshaft has increased from the first rotation speed, at a second rotation speed that is greater than the first rotation speed upon determining that the fuel has been ignited.

* * * * *